US005973603A

United States Patent [19]

Judy

[11] Patent Number: 5,973,603

[45] Date of Patent: Oct. 26, 1999

[54] HOUSE/GARAGE SMOKE DETECTOR

[76] Inventor: Leroy H. Judy, 600 Newberry Rd., Middletown, Pa. 17057

[21] Appl. No.: 08/992,139

[22] Filed: Dec. 17, 1997

[51] Int. Cl.[6] ..... G08B 17/10

[52] U.S. Cl. ..... 340/628; 340/508; 340/521; 340/533; 340/584; 340/632; 340/636; 340/693.2

[58] Field of Search ..... 340/506, 508, 340/521, 533, 577, 584, 628, 629, 630, 632, 636, 693.2

[56] References Cited

U.S. PATENT DOCUMENTS 4,972,181 11/1990 Fiene ..... 340/628
5,146,209 9/1992 Beghelli ..... 340/628
5,745,040 4/1998 Loughridge ..... 340/628
5,786,767 7/1998 Severino ..... 340/628
5,815,075 9/1998 Lewiner et al. ..... 340/628

*Primary Examiner*—Daniel J. Wu

[57] ABSTRACT

A house and garage alarm system is provided including at least one detector housing with a smoke and/or carbon monoxide detector situated therein. A power source is situated within the detector housing. An alarm housing is included which is connected to the corresponding detector housing and resides distant therefrom for indicating to a user that either smoke and/or carbon monoxide has been detected by the detector.

2 Claims, 2 Drawing Sheets

HOUSE/GARAGE SMOKE DETECTOR

BACKGROUND OF THE INVENTION

1. Field of the Invention

The present invention relates to smoke detectors and more particularly pertains to a new house/garage smoke detector for permitting the convenient installation of a system which alerts a user of the presence of a distance fire within a house or garage.

2. Description of the Prior Art

The use of smoke detectors is known in the prior art. More specifically, smoke detectors heretofore devised and utilized are known to consist basically of familiar, expected and obvious structural configurations, notwithstanding the myriad of designs encompassed by the crowded prior art which have been developed for the fulfillment of countless objectives and requirements.

Known prior art smoke detectors include U.S. Pat. No. 4,641,127; U.S. Pat. No. 4,688,183; U.S. Pat. No. 5,319,698; U.S. Pat. No. 4,581,606; U.S. Pat. No. 4,224,611; and U.S. Pat. No. 4,176,346.

In these respects, the house/garage smoke detector according to the present invention substantially departs from the conventional concepts and designs of the prior art, and in so doing provides an apparatus primarily developed for the purpose of permitting the convenient installation of a system which alerts a user of the presence of a distance fire.

SUMMARY OF THE INVENTION

In view of the foregoing disadvantages inherent in the known types of smoke detectors now present in the prior art, the present invention provides a new house/garage smoke detector construction wherein the same can be utilized for permitting the convenient installation of a system which alerts a user of the presence of a distance fire.

The general purpose of the present invention, which will be described subsequently in greater detail, is to provide a new house/garage smoke detector apparatus and method which has many of the advantages of the smoke detectors mentioned heretofore and many novel features that result in a new house/garage smoke detector which is not anticipated, rendered obvious, suggested, or even implied by any of the prior art smoke detectors, either alone or in any combination thereof.

To attain this, the present invention generally comprises a building having a lower basement with a water heater and a heater unit and upper living quarters; a garage situated distant the building for storing purposes; a plurality of detector housings including a first detector housing situated within the basement of the building and a second detector housing situated within the garage; a plurality of smoke detectors each situated within an associated one of the detector housings and including a detection module adapted to generate an enable signal upon the detection of an amount of smoke greater than a predetermined amount, an oscillator connected to the detection module and adapted to emit a first activation signal with a unique associated frequency upon the receipt of the enable signal, an audio amp connected to the oscillator for transmitting the first activation signal to an output thereof at a greater magnitude upon the receipt thereof, and a signal output jack connected to the output of the audio amp; a plurality of carbon monoxide detectors each situated within an associated one of the detector housings including a detection module adapted to generate an enable signal upon the detection of an amount of carbon monoxide greater than a predetermined amount, an oscillator connected to the detection module and adapted to emit a second activation signal with a unique associated frequency upon the receipt of the enable signal, an audio amp connected to the oscillator for transmitting the second activation signal to an output thereof at a greater magnitude upon the receipt thereof, whereby the signal output jack is connected to the output of the audio amp of the carbon monoxide detector; a plurality of power conversion mechanisms each situated within a corresponding one of the detector housings, each power conversion mechanism including a transformer connected to a conventional alternating current source of a first voltage for stepping down the first voltage to a second voltage less than the first voltage, a bridge rectifier for rectifying the alternating current, a voltage regulator for converting the rectified alternating current to a direct circuit, and a battery connected to an output of the voltage regulator with a diode connected therebetween for providing direct current upon the lack of receipt of the alternating current by the transformer and further recharging upon the receipt of the alternating current by the transformer, each power conversion mechanism connected to the smoke detector and carbon monoxide detector situated within the associated detector housing and further connected to the signal output jack mounted on the associated detector housing; a plurality of alarm housings each having a signal input jack, a tone detector connected to the signal input jack with a capacitor coupled therebetween for transmitting the activation signal to an output thereof upon the receipt thereof, and an audible alarm connected to the output of the tone detector with a voltage controlled switch connected therebetween for emitting a audible tone corresponding to the frequency of the activation signal upon the receipt thereof, the alarm housings including a first alarm housing situated within the living quarters of the building and a second alarm housing mounted on a exterior surface of the garage; a first set of wires including a first wire removably connected between the signal input jack of the first alarm housing and the signal output jack of the first detector housing for transferring power and activation signals therebetween; a second set of wires including a first wire removably connected between the signal input jack of the second alarm housing and the signal output jack of the second detector housing for transferring power and activation signals therebetween.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new house/garage smoke detector apparatus and method which has many of the advantages of the smoke detectors mentioned heretofore and many novel features that result in a new house/garage smoke detector which is not anticipated, rendered obvious, suggested, or even implied by any of the prior art smoke detectors, either alone or in any combination thereof.

It is another object of the present invention to provide a new house/garage smoke detector which may be easily and efficiently manufactured and marketed.

It is a further object of the present invention to provide a new house/garage smoke detector which is of a durable and reliable construction.

An even further object of the present invention is to provide a new house/garage smoke detector which is susceptible of a low cost of manufacture with regard to both materials and labor, and which accordingly is then susceptible of low prices of sale to the consuming public, thereby making such house/garage smoke detector economically available to the buying public.

Still yet another object of the present invention is to provide a new house/garage smoke detector which provides in the apparatuses and methods of the prior art some of the advantages thereof, while simultaneously overcoming some of the disadvantages normally associated therewith.

Still another object of the present invention is to provide a new house/garage smoke detector for permitting the convenient installation of a system which alerts a user of the presence of a distance fire.

Even still another object of the present invention is to provide a new house/garage smoke detector that includes at least one detector housing with at least one of a smoke and carbon monoxide detector situated therein. A power back-up system is situated within the detector housing. An alarm housing is included which is connected to the corresponding detector housing and resides distant therefrom for indicating to a user that either smoke or carbon monoxide has been detected by the detector.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
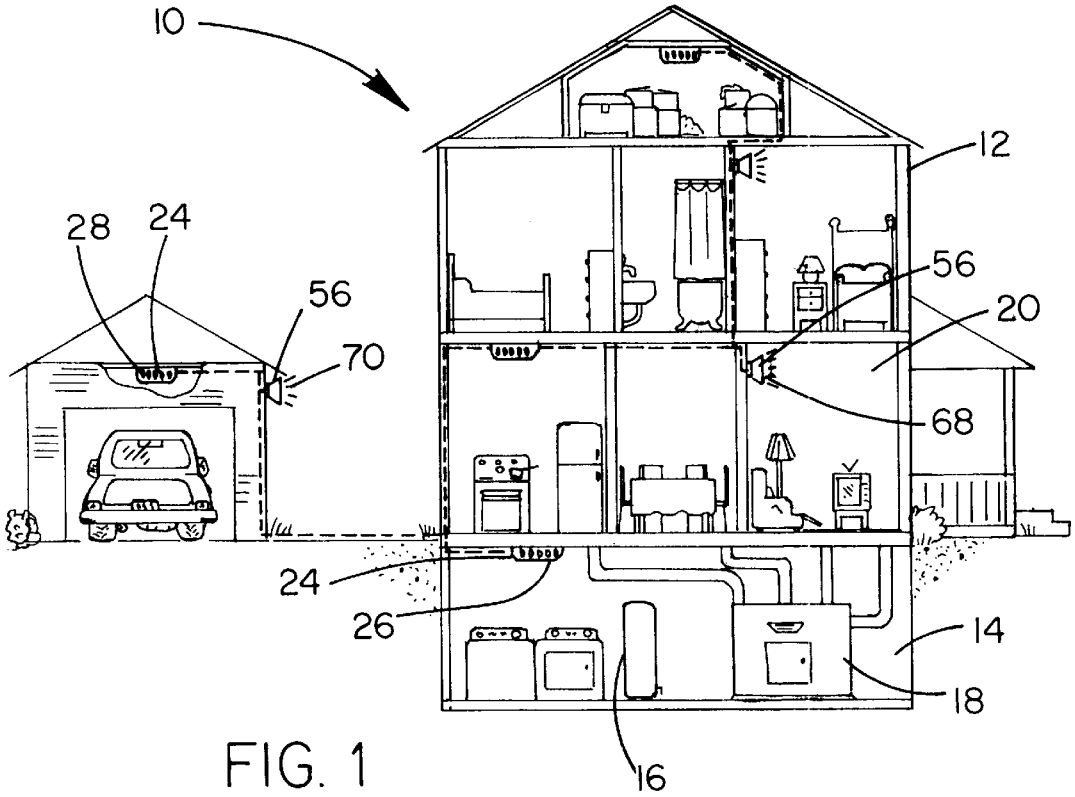
FIG. 1 is an illustration of a new house/garage smoke detector according to the present invention.

With reference now to the drawings, and in particular to FIGS. 1 through 5 thereof, a new house/garage smoke detector embodying the principles and concepts of the present invention and generally designated by the reference numeral 10 will be described.

The system 10 of the present invention is adapted for use with a building 12 having a lower basement 14 with a water heater 16 and a heater unit 18 and upper living quarters 20. As shown in FIG. 1, a garage 22 is situated distant the building for storing purposes. In an alternate embodiment, the garage and the building may form a single unit. Furthermore, the building may take the form of any type of business building, government building or the like.

Next provided is a plurality of detector housings 24 including a first detector housing 26 situated within the basement of the building. Associated therewith is a second detector housing 28 situated within the garage.

Also included is a plurality of smoke detectors 30 each situated within an associated one of the detector housings. Such smoke detectors each include a detection module 32 adapted to generate an enable signal upon the detection of an amount of smoke greater than a predetermined amount. An oscillator 34 is connected to the detection module and adapted to emit a first activation signal with a unique associated frequency upon the receipt of the enable signal. Connected to the oscillator is an audio amp 36 for transmitting the first activation signal to an output thereof at a greater magnitude upon the receipt thereof. Lastly, a signal output jack 38 is connected to the output of the audio amp. Note FIG. 4.

Also situated within an associated one of the detector housings is one of a plurality of carbon monoxide detectors 40. The carbon monoxide detectors include a detection module adapted to generate an enable signal upon the detection of an amount of carbon monoxide greater than a predetermined amount. An oscillator is connected to the detection module and adapted to emit a second activation signal with a unique associated frequency upon the receipt of the enable signal. Similar to that of the smoke detector, an audio amp of the carbon monoxide detector is adapted for transmitting the second activation signal to an output thereof at a greater magnitude upon the receipt thereof. The signal output jack is connected to the output of the audio amp of the carbon monoxide detector for reasons that will become apparent hereinafter.

It should be noted that in addition to or instead of detectors for smoke and carbon monoxide, detectors are also included for detecting natural gas and propane gas. Such detectors function in a manner similar to those described hereinabove with only the exception of what type of entity is being detected.

Figure 2:
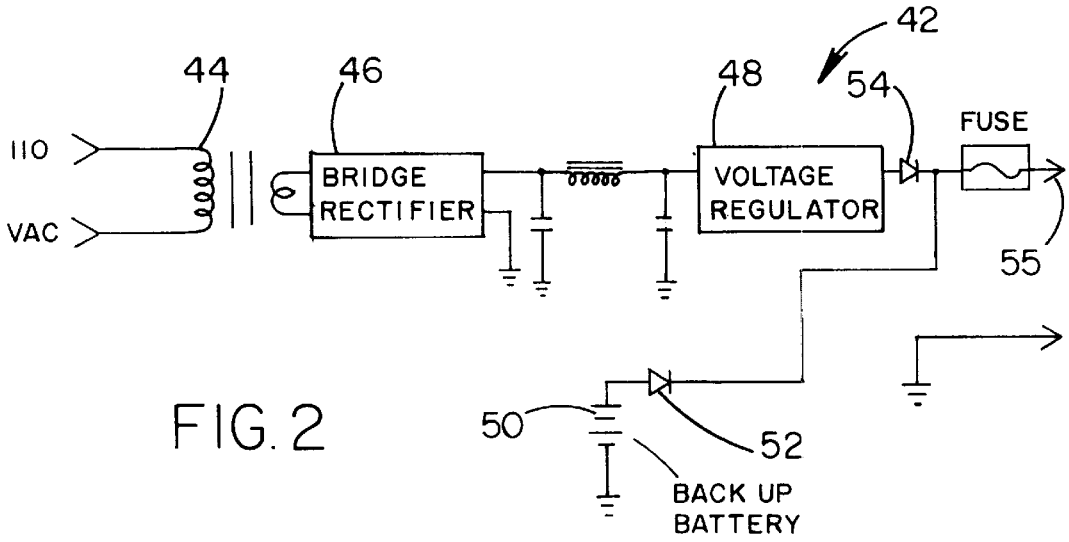
FIG. 2 is a schematic diagram of the power conversion mechanism of the present invention.

As shown in FIG. 2, a plurality of power conversion mechanisms 42 are each situated within a corresponding one of the detector housings. Each power conversion mechanism includes a transformer 44 connected to a conventional alternating current source of a first voltage for stepping down the first voltage to a second lesser voltage. A bridge rectifier 46 is included for rectifying the alternating current. A voltage regulator 48 is provided for converting the rectified alternating current to a direct circuit. Finally, a battery 50 is connected to an output of the voltage regulator with a diode 52 connected therebetween. Yet another diode 54 is connected between the output of the voltage regulator and the signal output jack.

By this structure, direct current is supplied by the battery upon the lack of receipt of the alternating current by the transformer. Furthermore, the battery is recharged upon the receipt of the alternating current by the transformer while direct current is being supplied by the voltage regulator. Each power conversion mechanism is connected to the smoke detector and carbon monoxide detector situated within the associated detector housing. The power conversion mechanism is connected to the signal output jack mounted on the associated detector housing.

Figure 5:
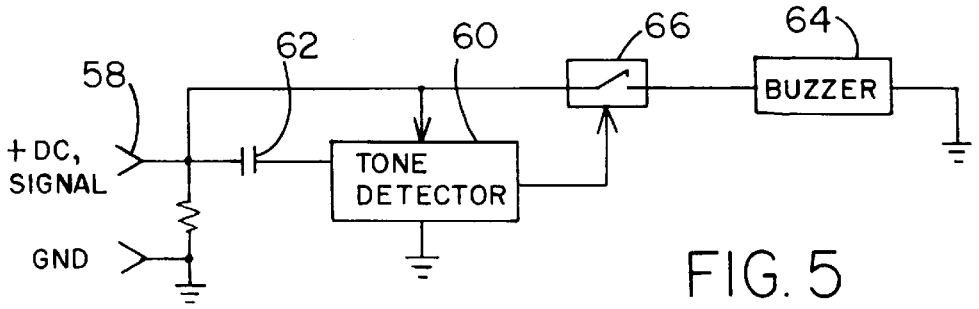
FIG. 5 is a schematic diagram of the various electrical components associated with the alarm housings of the present invention.

Shown in FIG. 5 is one of a plurality of separate alarm housings 56. Each alarm housing has a signal input jack 58. A tone detector 60 is connected to such signal input jack with a capacitor 62 coupled therebetween. During use, the tone detector serves to transmit the activation signal to an output thereof upon the receipt thereof. An audible alarm 64 is connected to the output of the tone detector with a voltage controlled switch 66, such as a transistor, connected therebetween. Such arrangement allows for the emission of an audible tone corresponding to the frequency of the activation signal upon the receipt thereof.

It should be noted that the alarm housings include a first alarm housing 68 situated within the living quarters of the building and a second alarm housing 70 mounted on an exterior surface of the garage. In the preferred embodiment, the second alarm housing is equipped with various weatherproof features such as a mesh grill and durable heat resistant plastic. In an alternate embodiment, the second alarm housing may be situated within the building in the case wherein the garage and building are one entity.

Figure 3:
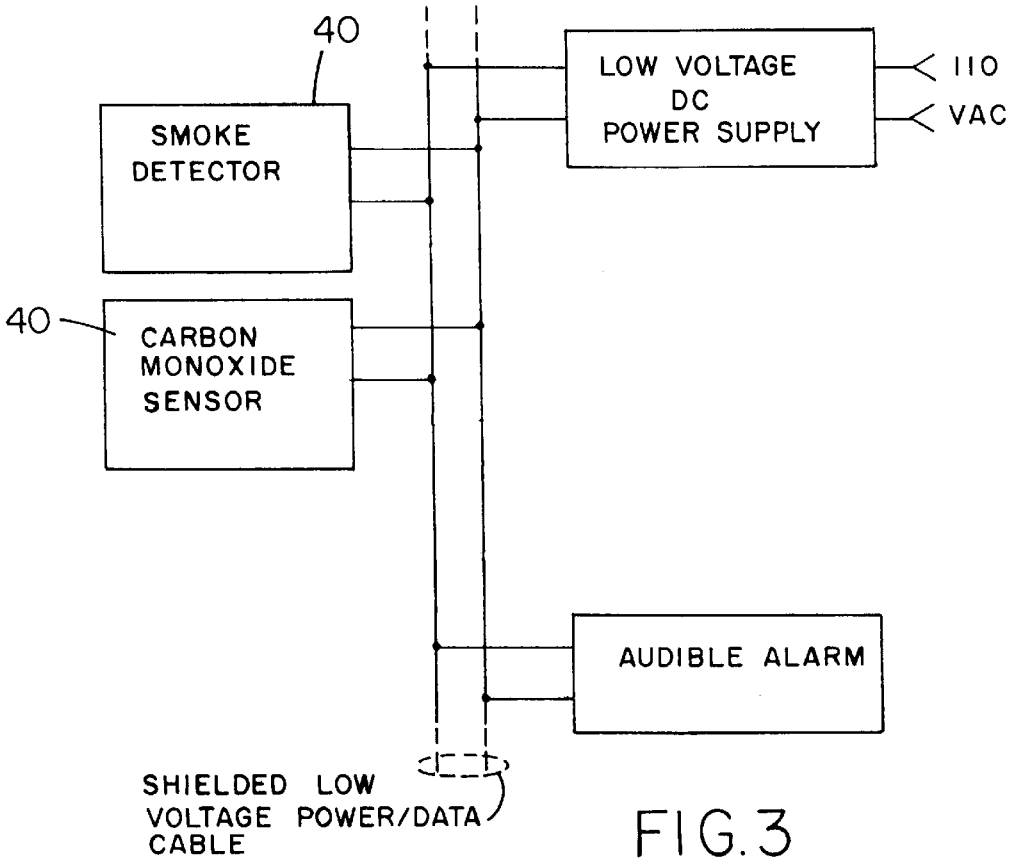
FIG. 3 is a schematic diagram of the interconnection of the various electrical components of the present invention.
Figure 4:
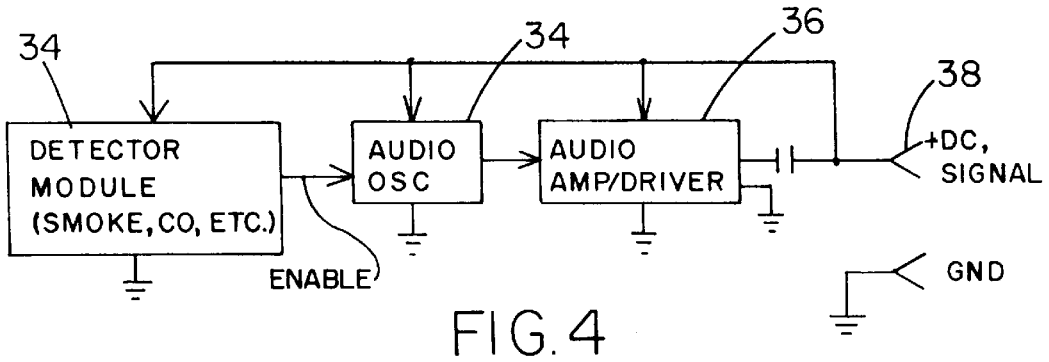
FIG. 4 is a schematic diagram of the various electrical components associated with the smoke and carbon monoxide detectors of the present invention.

For providing connectivity between the alarm and detection housings in accordance with FIG. 3, a first and second set of wires are provided. The first set of wires includes a first wire removably connected between the signal input jack of the first alarm housing and the signal output jack of the first detector housing. The second set of wires includes a first wire connected between the signal input jack of the second alarm housing and the signal output jack of the second detector housing. In the alternative, a transmitter or receiver may be employed in lieu of the wires for affording communication between the detector and alarm housings. The first and second set of wires each include a second wire removably connected between each detector housing and alarm housing which constitutes a ground line.

By such interconnection, DC power and the activation signals are transmitted between the alarm housing and corresponding detection housings over a single line. Such allows the convenient installation of the present invention by merely drilling a hole between insulated walls and floors without concern for UL alternating current regulations. As shown in the Figures, the capacitors are configured such that DC power is provided to the voltage controlled switch and the alternating activation signals are passed to the tone detectors. A resistor is preferably connected between the first wire and second wire within the alarm housings. Such resistor must be of a high enough resistance as to provide adequate power to the voltage control switch.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An house and garage alarm system comprising, in combination:

a building having a lower basement with a water heater and a heater unit and upper living quarters;

a garage situated distant the building for storing purposes;

a plurality of detector housings including a first detector housing situated within the basement of the building and a second detector housing situated within the garage;

a plurality of smoke detectors each situated within an associated one of the detector housings and including a detection module adapted to generate an enable signal upon the detection of an amount of smoke greater than a predetermined amount, an oscillator connected to the detection module and adapted to emit a first activation signal with a unique associated frequency upon the receipt of the enable signal, an audio amp connected to the oscillator for transmitting the first activation signal to an output thereof at a greater magnitude upon the receipt thereof, and a signal output jack connected to the output of the audio amp;

a plurality of carbon monoxide detectors each situated within an associated one of the detector housings including a detection module adapted to generate an enable signal upon the detection of an amount of carbon monoxide greater than a predetermined amount, an oscillator connected to the detection module and adapted to emit a second activation signal with a unique associated frequency upon the receipt of the enable signal, an audio amp connected to the oscillator for transmitting the second activation signal to an output thereof at a greater magnitude upon the receipt thereof, whereby the signal output jack is connected to the output of the audio amp of the carbon monoxide detector;

a plurality of power conversion mechanisms each situated within a corresponding one of the detector housings, each power conversion mechanism including a transformer connected to a conventional alternating current source of a first voltage for stepping down the first voltage to a second voltage less than the first voltage, a bridge rectifier for rectifying the alternating current, a voltage regulator for converting the rectified alternating current to a direct circuit, and a battery connected to an output of the voltage regulator with a diode connected therebetween for providing direct current upon the lack of receipt of the alternating current by the transformer and further recharging upon the receipt of the alternating current by the transformer, each power conversion mechanism connected to the smoke detector and carbon monoxide detector situated within the associated detector housing and further connected to the signal output jack mounted on the associated detector housing;

a plurality of alarm housings each having a signal input jack, a tone detector connected to the signal input jack with a capacitor coupled therebetween for transmitting the activation signal to an output thereof upon the receipt thereof, and an audible alarm connected to the output of the tone detector with a voltage controlled switch connected therebetween for emitting a audible tone corresponding to the frequency of the activation signal upon the receipt thereof, the alarm housings including a first alarm housing situated within the living quarters of the building and a second alarm housing mounted on a exterior surface of the garage;

a first set of wires including a first wire removably connected between the signal input jack of the first alarm housing and the signal output jack of the first detector housing for transferring power and activation signals therebetween;

a second set of wires including a first wire removably connected between the signal input jack of the second alarm housing and the signal output jack of the second detector housing for transferring power and activation signals therebetween.

2. A house and garage alarm system comprising:

a building having a lower basement;

a garage situated distant the building;

a plurality of detector housings including a first detector housing situated in the basement of the building and a second detector housing situated in the garage;

a plurality of smoke detectors each situated in an associated one of the detector housings and including a detection module adapted to generate an enable signal upon the detection of an amount of smoke greater than a predetermined amount, an oscillator connected to the detection module and adapted to emit a first activation signal with a unique associated frequency upon the receipt of the enable signal, an audio amp connected to the oscillator for transmitting the first activation signal to an output thereof at a greater magnitude upon the receipt thereof, and a signal output jack connected to the output of the audio amp;

a plurality of carbon monoxide detectors each situated in an associated one of the detector housings including a detection module adapted to generate an enable signal upon the detection of an amount of carbon monoxide greater than a predetermined amount, an oscillator connected to the detection module and adapted to emit a second activation signal with a unique associated frequency upon the receipt of the enable signal, an audio amp connected to the oscillator for transmitting the second activation signal to an output thereof at a greater magnitude upon the receipt thereof, whereby the signal output jack is connected to the output of the audio amp of the carbon monoxide detector;

a plurality of power conversion mechanisms each situated in a corresponding one of the detector housings, each power conversion mechanism including a transformer connected to a conventional alternating current source of a first voltage for stepping down the first voltage to a second voltage less than the first voltage, a bridge rectifier for rectifying the alternating current, a voltage regulator for converting the rectified alternating current to a direct circuit, and a battery connected to an output of the voltage regulator with a diode connected therebetween for providing direct current upon the lack of receipt of the alternating current by the transformer and further recharging upon the receipt of the alternating current by the transformer, each power conversion mechanism connected to the smoke detector and carbon monoxide detector situated within the associated detector housing and further connected to the signal output jack mounted on the associated detector housing;

a plurality of alarm housings each having a signal input jack, a tone detector connected to the signal input jack with a capacitor coupled therebetween for transmitting the activation signal to an output thereof upon the receipt thereof, and an audible alarm connected to the output of the tone detector with a voltage controlled switch connected therebetween for emitting a audible tone corresponding to the frequency of the activation signal upon the receipt thereof, the alarm housings including a first alarm housing situated in the building and a second alarm housing mounted to the garage;

a first set of wires including a first wire removably connected between the signal input jack of the first alarm housing and the signal output jack of the first detector housing for transferring power and activation signals therebetween; and a second set of wires including a first wire removably connected between the signal input jack of the second alarm housing and the signal output jack of the second detector housing for transferring power and activation signals therebetween.

* * * * *